US009702213B2

(12) United States Patent
Britton

(10) Patent No.: US 9,702,213 B2
(45) Date of Patent: Jul. 11, 2017

(54) MARINE RISER SYSTEM

(71) Applicant: Cameron International Corporation, Houston, TX (US)

(72) Inventor: Jim Britton, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/854,090

(22) Filed: Sep. 15, 2015

(65) Prior Publication Data

US 2017/0074063 A1 Mar. 16, 2017

(51) Int. Cl.

| | |
|---|---|
| ***E21B 17/01*** | (2006.01) |
| ***E21B 33/038*** | (2006.01) |
| ***E21B 17/08*** | (2006.01) |
| *E21B 33/064* | (2006.01) |

(52) U.S. Cl.

CPC ..... *E21B 33/038* (2013.01); *E21B 17/01* (2013.01); *E21B 17/085* (2013.01); *E21B 33/064* (2013.01)

(58) Field of Classification Search

CPC ..... E21B 17/01; E21B 17/085; E21B 33/038; E21B 33/064

See application file for complete search history.

(56) References Cited

U.S. PATENT DOCUMENTS 3,135,538 A 6/1964 George
6,361,085 B2 * 3/2002 Nguyen ..... F16L 23/003 285/368
8,313,264 B2 * 11/2012 Webjorn ..... F16L 23/032 285/368
8,657,013 B2 * 2/2014 Kotrla ..... E21B 17/18 138/177
2001/0000225 A1 4/2001 Nguyen
2009/0212092 A1 * 8/2009 Stol ..... B23K 20/12 228/112.1
2012/0312544 A1 12/2012 Tavner et al.
2013/0043036 A1 2/2013 Kotrla et al.
2016/0032662 A1 * 2/2016 Walker ..... E21B 17/085 166/367

(Continued)

FOREIGN PATENT DOCUMENTS

WO 2014150816 A1 9/2014

OTHER PUBLICATIONS

International Search Report and Written Opinion issued in corresponding application No. PCT/US2016/046475 dated Nov. 18, 2016, 13 pgs.

*Primary Examiner* — Matthew R Buck
(74) *Attorney, Agent, or Firm* — Chamberlain Hrdlicka

(57) ABSTRACT

The present disclosure generally relates to a riser system for coupling a surface platform to a wellhead and, in an embodiment described herein, more particularly provides a riser flange for coupling adjacent riser sections. A main tube of the riser system forms an annulus for fluid flow between the wellhead and the platform. A flange extends radially from each end of the main tube. The flange includes an offset outer face and a raised inner face. The flange further includes a plurality of bolt and auxiliary line holes distributed about the flange. The bolt holes are all located within the raised inner face of the flange. The bolt holes are angled with respect to the axis of the main tube. A transition between the main tube and riser flange is gradually tapered and convex.

21 Claims, 6 Drawing Sheets

(56) References Cited

U.S. PATENT DOCUMENTS

2016/0076312 A1* 3/2016 Fraczek ..... E21B 19/002
166/367
2016/0076323 A1* 3/2016 Fraczek ..... E21B 17/01
166/367

* cited by examiner

MARINE RISER SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Drilling and production operations for the recovery of offshore deposits of crude oil and natural gas are taking place in deeper and deeper waters. Drilling and production operations in deeper waters are typically carried out from floating vessels rather than from stationary platforms resting on the ocean floor and commonly used in shallow water. According to conventional procedures, a vessel is dynamically stationed, or moored, above a well site on the ocean floor. After a wellhead has been established, a blowout preventer ("BOP") stack is mounted on the wellhead to control the pressure in the wellhead. After drilling is completed, a production tree is mounted on the wellhead to control produced fluids.

Subsea well boreholes are typically drilled with multiple sections having decreasing diameters as the wellbore extends deeper into the earth. Each borehole is cased with a casing string that extends into the borehole from a wellhead and is cemented within the borehole. The drilling, casing installation, and cementing are performed through one or more drilling risers that extend from the wellhead to the surface, such as to a floating drilling vessel. After drilling operations are completed, i.e., during production operations, produced fluids may travel to the surface through one or more production risers that extend from the wellhead to the surface.

Risers comprise a series of riser joints. Each riser joint includes flanges on each end of the joint. The flanges of one joint are made up, or bolted together, with the flange of an adjacent joint. In this way, a riser string is formed extending from the surface to the wellhead at the sea floor. The flanged connections between adjacent riser joints must contain the internal pressure of the riser string and must withstand large external loads experienced as a result of environmental conditions, i.e., the weight of the riser string and its movement in a body of water.

Traditionally, flanges are designed with raised face diameters inside the bolt circle. When made up, this design creates a highly localized preload near the flange inner diameter where elastomeric or metal-to-metal bore seals are located. This high preload is necessary to prevent flange face separation at the inner diameter, which would result in loss of bore seal integrity. The high preload is taxing on the riser flanges. Accordingly, an improved riser flange design which eliminates the need for high preload stresses encountered by existing designs is desirable.

DESCRIPTION OF THE DRAWINGS

For a more detailed description of the embodiments, reference will now be made to the following accompanying drawings.

DETAILED DESCRIPTION OF THE EMBODIMENTS

Figure 1:
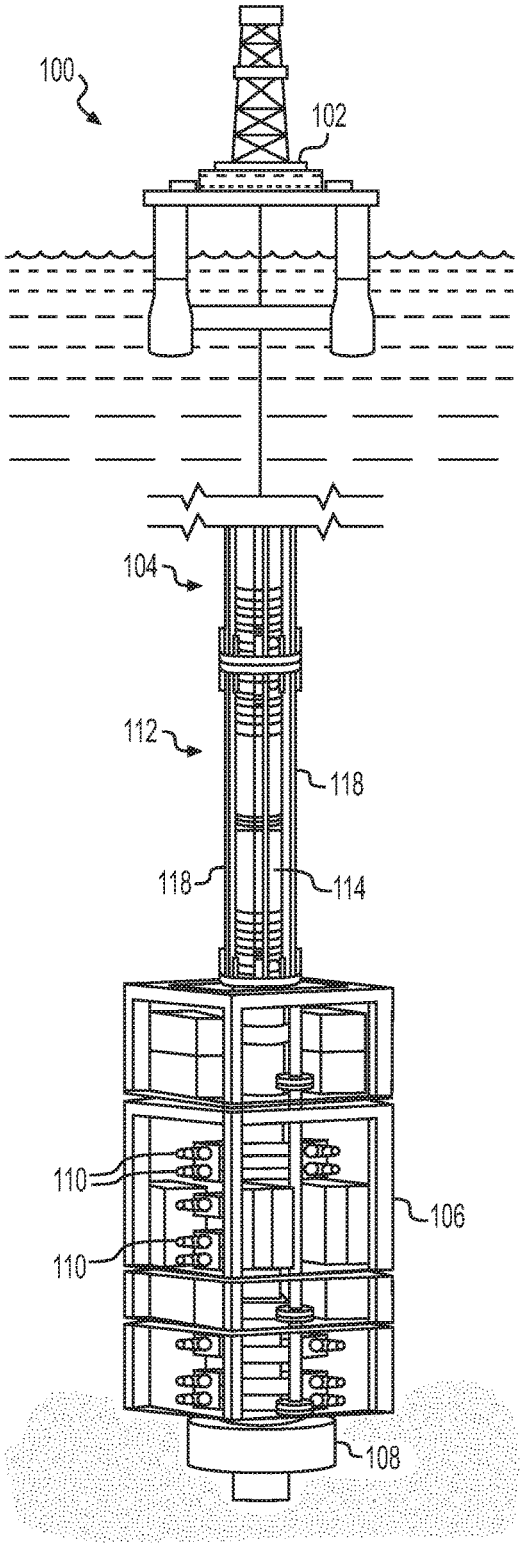
FIG. 1 shows a schematic view of a drilling system.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Turning now to FIG. 1, a schematic view of a drilling system 100 is shown, by way of example. The drilling system 100 includes a drilling rig 102, a riser string 104, and a blowout preventer stack 106. The blowout preventer 106 is connected to a wellhead housing 108 located on the ocean floor. The blowout preventer stack 106 includes multiple blowout preventers 110 in a vertical arrangement to control well bore pressure. The riser string 104 is coupled to the upper end of blowout preventer stack 106. The riser string 104 includes multiple riser sections or riser joints 112 connected end to end and extending upward to the drilling rig 102. Each riser joint 112 includes a main tube 114 and one or more auxiliary fluid lines 118.

Figure 2:
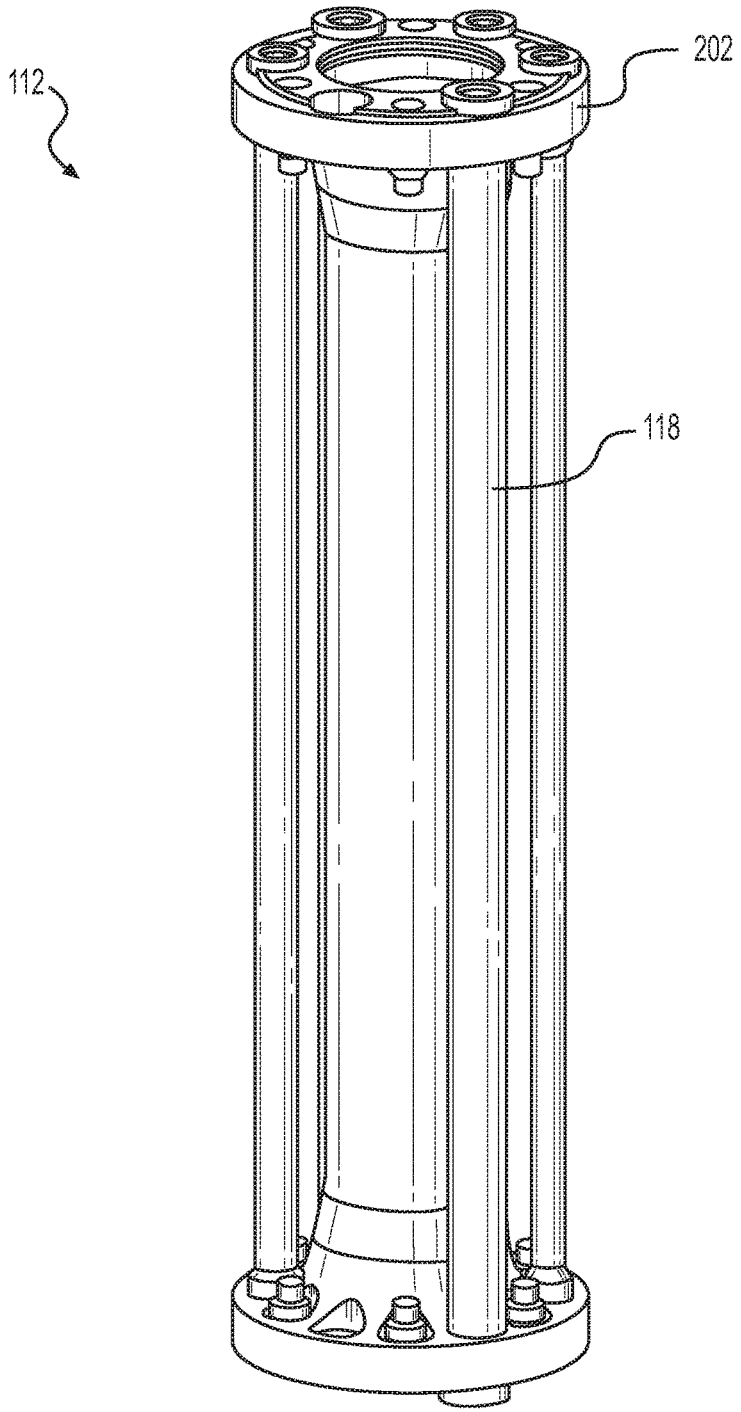
FIG. 2 shows a riser section including a main tube and auxiliary lines.
Figure 3:
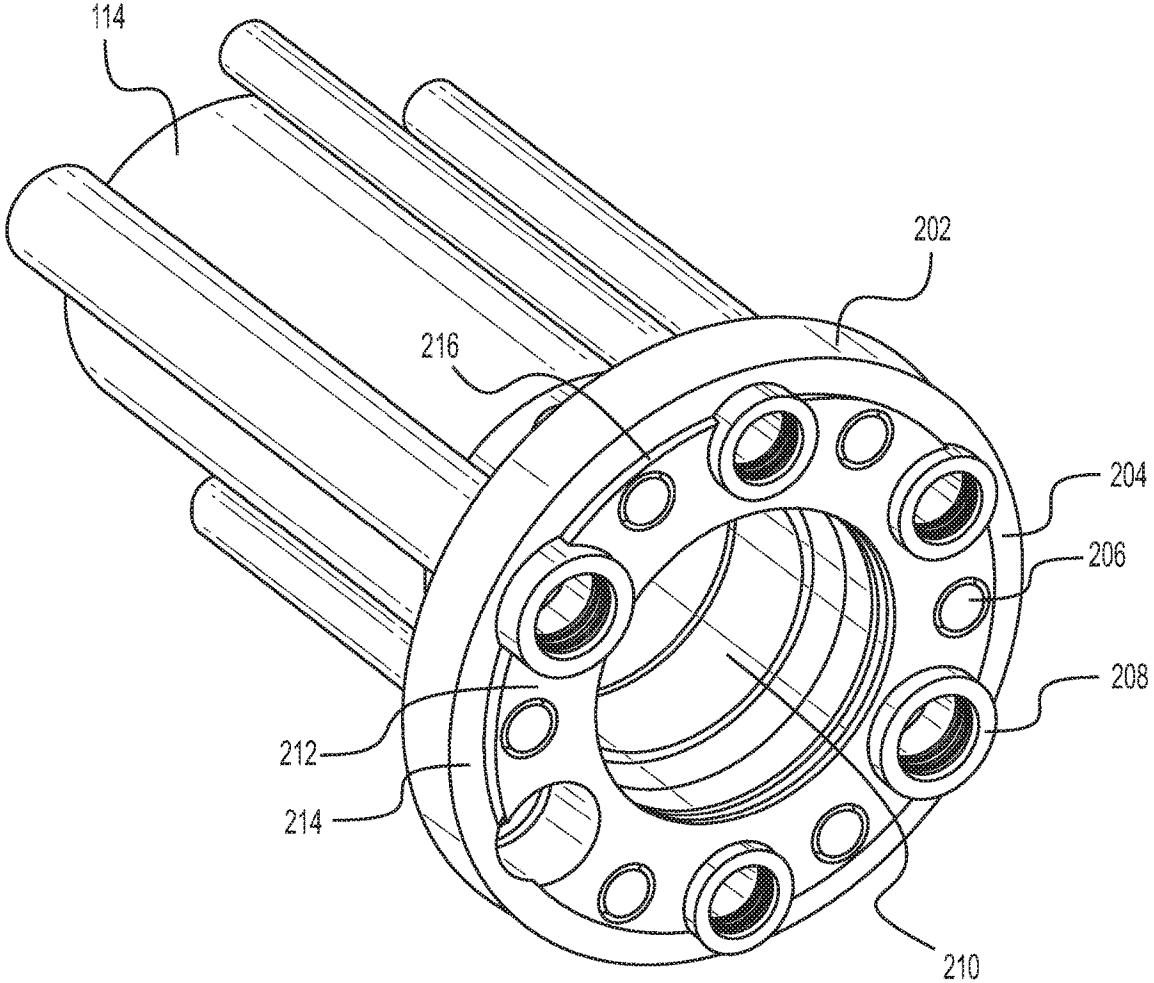
FIG. 3 shows a perspective view of a riser flange including bolt holes and auxiliary line holes.
Figure 4:
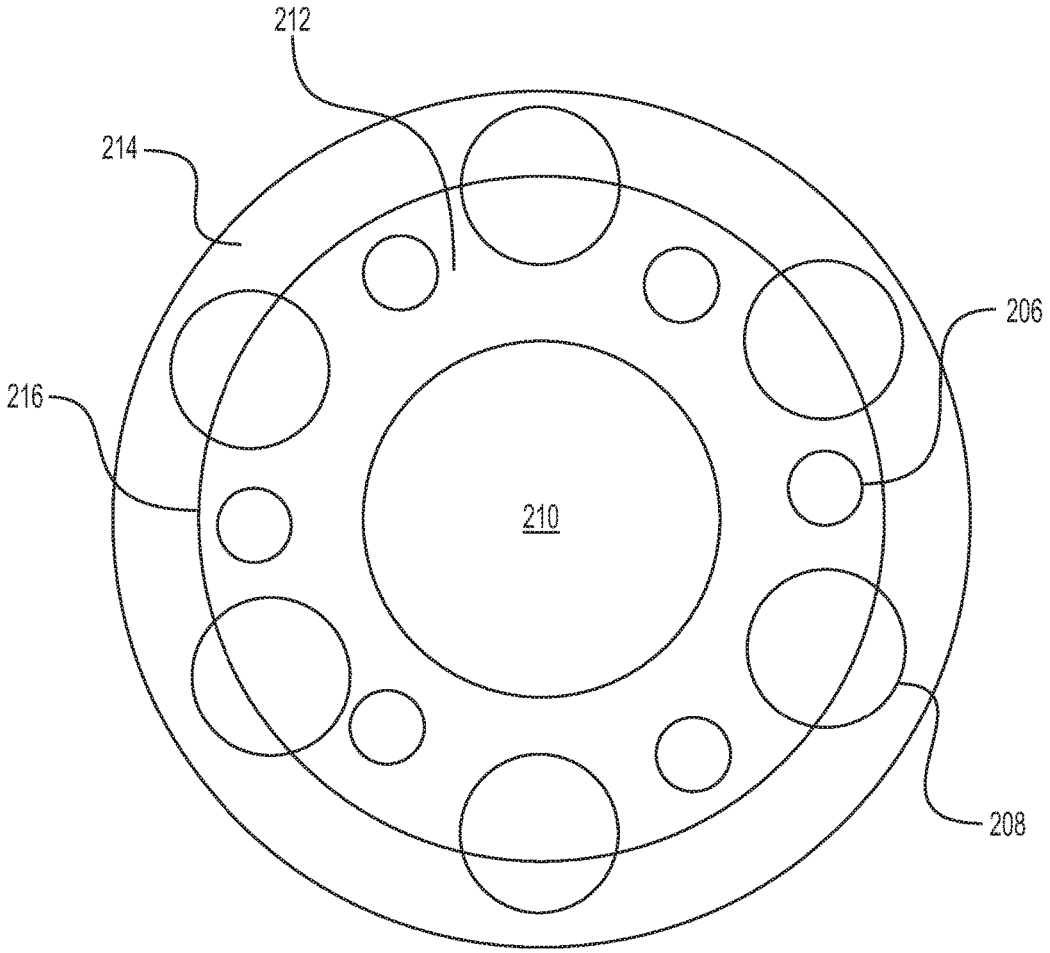
FIG. 4 shows an end view of a riser flange including bolt holes and auxiliary line holes.

FIGS. 2 through 4 show various views of riser joint 112 and flange 202. FIG. 2 shows riser joint 112 including auxiliary lines 118 in accordance with various embodiments. Auxiliary lines 118 can include choke and kill lines for delivering pressurized fluid to equipment at the wellhead, such as to blowout preventer stack 106. Riser joint 112 includes the main tube 114 with flanges 202 located at either end of main tube 114. Riser joint 112 is configured to be connected end-to-end with another section of riser joint by bolts, dogs, or other suitable fasteners. Each end of the main tube 114 and the auxiliary fluid lines 118 sealingly mates with a corresponding end of a different instance of the riser section 112 to form continuous fluid channels between the rig 102 and the blowout preventer 106.

Turning now to FIGS. 3 and 4, FIG. 3 shows a perspective view of an embodiment of riser flange 202 and FIG. 4 shows an end view of flange 202. As shown, flange 202 comprises a generally circular connection face 204. As shown most clearly in FIG. 3, the connection face 204 includes a raised face 212 and an offset face 214. Raised face 212 can occupy any percentage of the surface area of connection face 204. For instance, raised face can comprise 25%, 50%, 75% of the surface area of connection face 204, or any other percentage.

Flange 202 also comprises six bolt holes 206 and six auxiliary line holes 208. It should be appreciated that the illustrated number of bolt holes 206 is merely for illustrative purposes, and any number of bolt holes 206 is envisioned, such as two, three, four, five, six, seven, and so on. Bolt holes 206 are shown as spaced approximately 60° apart from the nearest bolt hole 206. The degree of separation between bolt holes 206 will vary depending on the number of bolt holes 206. In addition, bolt holes 206 may be spaced asymmetrically.

Bolt holes 206 are configured to receive bolts for fastening flange 202 of riser joint 112 to an adjacent flange of an adjacent riser joint 112, thereby providing for the end-to-end connections required to form a riser string. Auxiliary line holes 208 are configured to receive auxiliary lines 118, such as choke and kill lines and/or booster lines. Fluid passage 210 is formed within main tube 114 and generally serves as the conduit for tubulars extending from the surface to the well/wellbore and for fluid returning from the wellbore to the surface.

Bolt holes 206 are distributed about the connection face 204 of riser flange 202. Each bolt hole 206 is located entirely within the raised face 212. Auxiliary line holes 208, on the other hand, traverse the intersection 216 between raised face 212 and offset face 214. Bolt holes 206 are configured to receive a bolt which will extend beyond the raised surface of raised face 212. The portion of the bolt extending beyond the raised face 212 may then be inserted into a corresponding bolt hole on an adjacent face, thereby allowing for the two riser flanges to be made up. When made up, the riser flanges are put under a load which pulls the outer portions of flange 202 toward the outer portions of the adjacent flange. Existing raised-flange designs traditionally locate the bolt holes on the offset face or across the intersection of the offset face and the raised face. By locating all bolt holes within the diameter of the raised inner face, the present disclosure reduces the stresses experienced throughout the flange 202.

Figure 5:
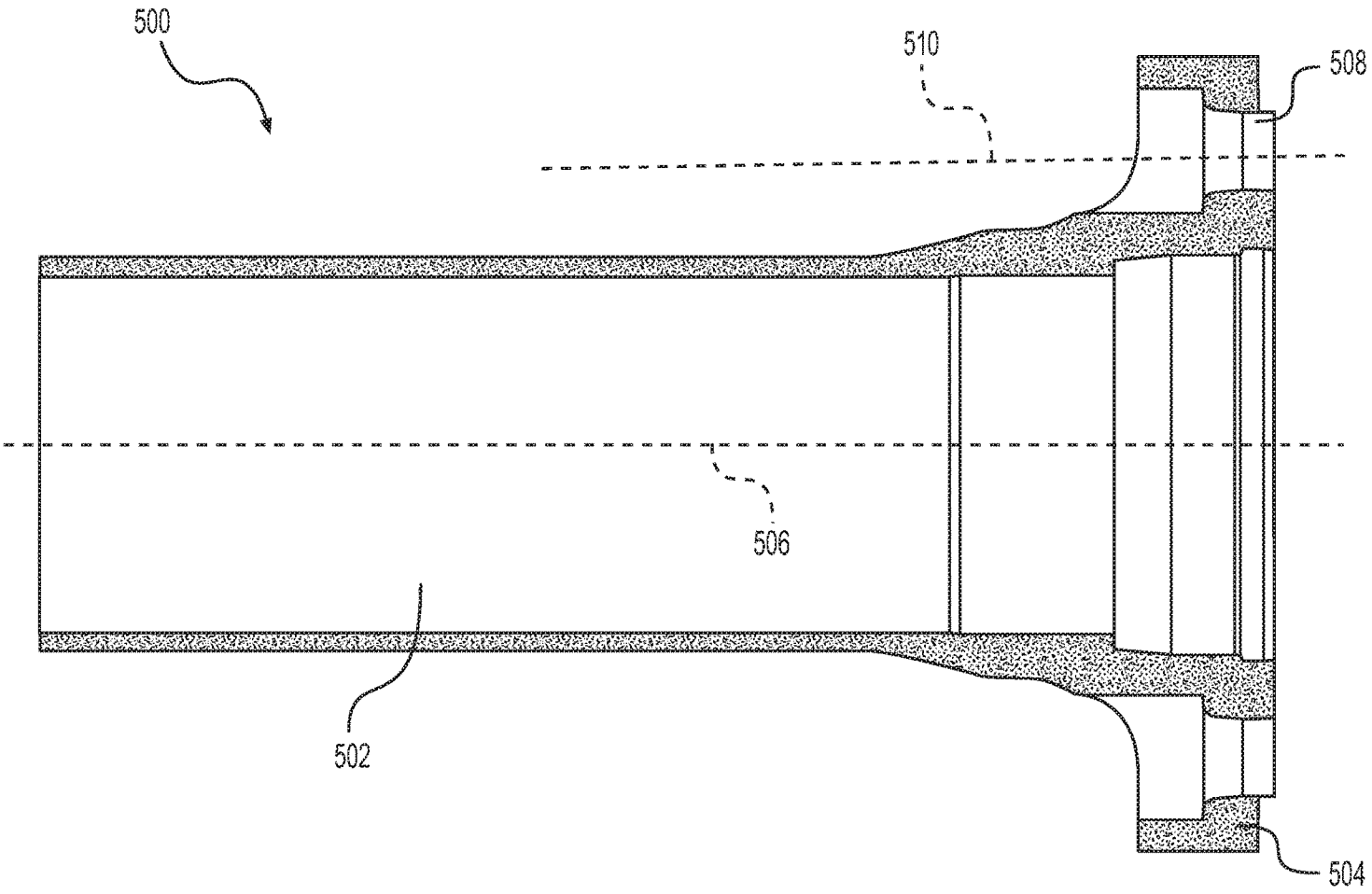
FIG. 5 shows a cross-sectional view of a riser joint including a main tube and a riser flange.

Turning now to FIG. 5, a cross-sectional view of a riser joint 500 is shown. Riser joint 500 includes a main tube 502 similar to main tube 114 discussed above. Further, riser joint 500 includes a riser flange 504, similar to riser flange 202 discussed above. Main tube 502 has a main tube longitudinal axis 506 which extends along riser joint 500. Riser flange 504 includes bolt holes 508. Bolt holes 508 have a bolt hole longitudinal axis 510 which is offset from longitudinal axis 506. Bolt hole longitudinal axis 510 can be offset at an angle from main tube longitudinal axis 506 by any number of degrees, such as 0.1°, 1°, 2°, 5°, 10°, and so on. The degree of offset between bolt hole longitudinal axis 510 and main tube longitudinal axis 506 will differ depending on the flange size, number of bolts, etc.

When a bolt is inserted through bolt hole 508 and into a corresponding bolt hole on an adjacent flange and the system is made up, a load is applied to riser flange 504, thereby pulling up on the outer perimeter of riser flange 504. When this occurs, bolt hole longitudinal axis 510 is pulled closer to parallel with main tube longitudinal axis 506 than prior to loading. This provides for reduced bending stress experienced by bolts inserted through bolt holes 508 as the bolts are not bending as significantly during loading.

Figure 6:
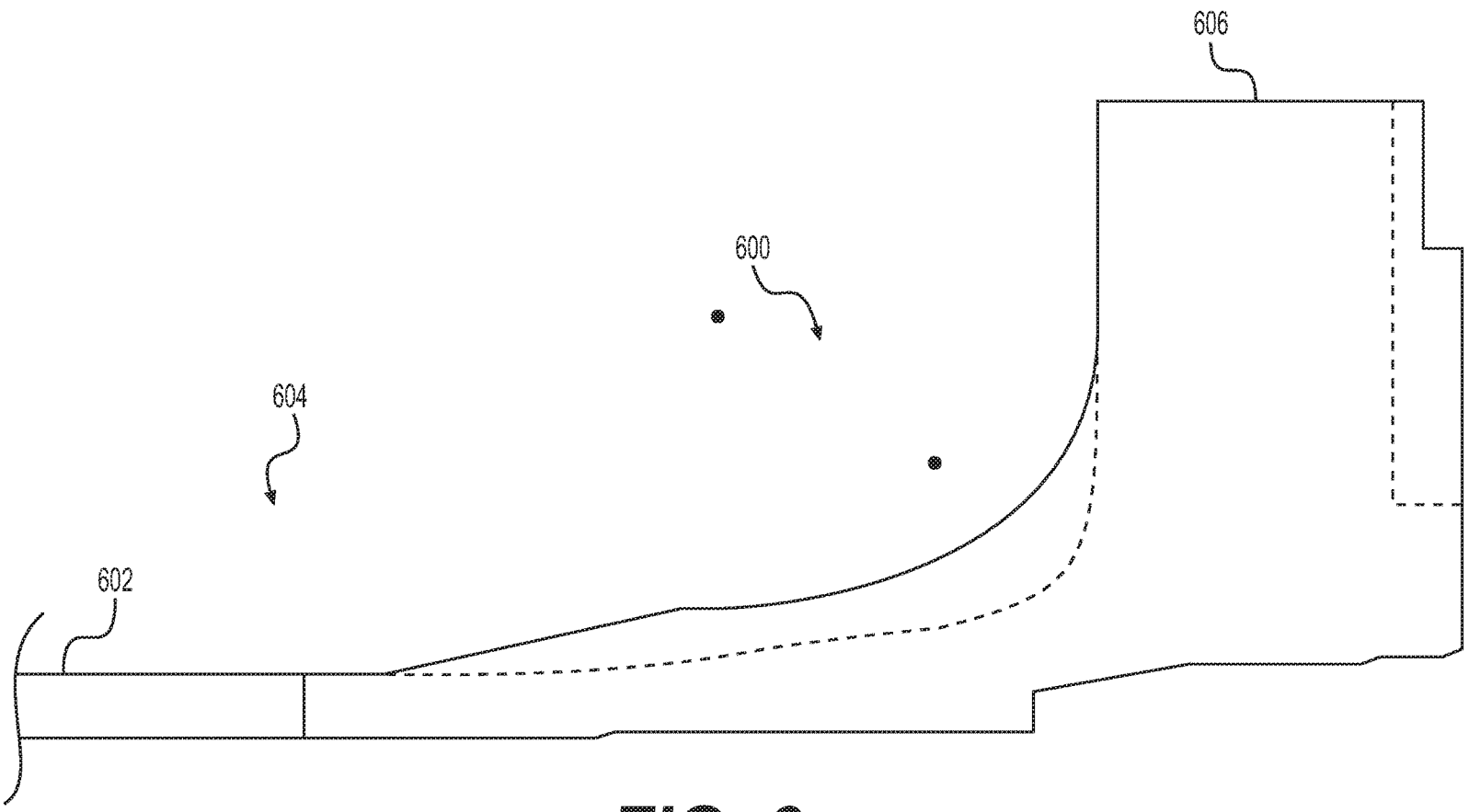
FIG. 6 shows a cross-sectional view of a profile of the transition between a main tube of a riser joint and a flange of a riser joint.

Turning now to FIG. 6, a cross-sectional view of a profile of the transition 600 between main tube 602 of riser joint 604 and the flange 606 of riser joint 604 is illustrated. Transition 600 is gradually tapered and generally convex between main tube 602 and riser flange 606. The degree of taper and convexity is optimized, and therefore will vary, depending on each different flange size. Generally, this gradual taper and convex transition 600 profile between main tube 602 and riser joint 604 reduces tensile load and bending load stresses experienced by the transition when riser joint 604 is made up with an adjacent riser joint.

In addition to the embodiments described above, many examples of specific combinations are within the scope of the disclosure, some of which are detailed below:

Example 1. A riser flange extending radially from an end of a riser section, the flange comprising:

an offset outer face;

a raised inner face adjacent the outer surface and defining an edge therebetween; and a plurality of bolt holes located on the raised inner surface, each bolt hole configured to receive a bolt configured to be coupled to a flange of an adjacent riser section.

Example 2. The riser flange of Example 1, further comprising a plurality of auxiliary-line holes each configured to receive an auxiliary line.

Example 3. The riser flange of Example 2, wherein the auxiliary lines are one or more of a choke line, a kill line, and a booster line.

Example 4. The riser flange of Example 1, wherein the riser section comprises a longitudinal axis extending along the length of the riser, further wherein each bolt hold comprises a longitudinal axis extending along the length of the bolt hole that is offset from the longitudinal axis of the riser section.

Example 5. The riser flange of Example 4, wherein the offset between the bolt hole longitudinal axis and the riser section longitudinal axis is reduced when the bolts are made up with a flange of an adjacent riser section.

Example 6. The riser flange of Example 1, wherein a transition between the riser section and the flange is tapered and convex.

Example 7. The riser flange of Example 1, wherein the flange comprises six bolt holes.

Example 8. A riser section for coupling a surface platform to a subsea mineral extraction component, the riser section comprising:

a main tube for fluid flow between the wellhead and the platform; and a flange extending radially from an end of the main tube, the flange comprising:

an offset outer face;

a raised inner face adjacent the outer surface and defining an edge therebetween; and a plurality of bolt holes located on the raised inner surface, each bolt hole configured to receive a bolt configured to be coupled to a flange of an adjacent riser section.

Example 9. The riser section of Example 8, further comprising a plurality of auxiliary-line holes each configured to receive an auxiliary line.

Example 10. The riser section of Example 9, wherein the auxiliary lines are one or more of a choke line, a kill line, and a booster line.

Example 11. The riser section of Example 8, wherein the riser section comprises a longitudinal axis extending along the length of the riser, further wherein each bolt hold comprises a longitudinal axis extending along the length of the bolt hole that is offset from the longitudinal axis of the riser section.

Example 12. The riser section of Example 11, wherein the offset between the bolt hole longitudinal axis and the riser section longitudinal axis is reduced when the bolts are made up with a flange of an adjacent riser section.

Example 13. The riser section of Example 8, wherein a transition between the riser section and the flange is tapered and convex.

Example 14. A subsea drilling or production system comprising:

a subsea wellhead; and a riser string located between the subsea wellhead and a surface platform, the riser string comprising a plurality of riser sections, at least one of the riser sections comprising a flange extending radially from an end of the riser section, the flange comprising:

an offset outer face;

a raised inner face adjacent the outer surface and defining an edge therebetween; and a plurality of bolt holes located on the raised inner surface, each bolt hole configured to receive a bolt configured to be coupled to a flange of an adjacent riser section.

Example 15. The subsea drilling or production system of Example 14, further comprising a blowout preventer located between to the riser string and the wellhead.

Example 16. The subsea drilling or production system of Example 14, further comprising a flange extending radially from each end of the riser section.

Example 17. The subsea drilling or production system of Example 14, further comprising a plurality of auxiliary-line holes each configured to receive an auxiliary line configured to deliver pressurized fluid to the wellhead.

Example 18. The subsea drilling or production system of Example 17, wherein the auxiliary lines are one or more of a choke line, a kill line, and a booster line.

Example 19. The subsea drilling or production system of Example 14, wherein the riser section comprises a longitudinal axis extending along the length of the riser, further wherein each bolt hold comprises a longitudinal axis extending along the length of the bolt hole that is offset from the longitudinal axis of the riser section.

Example 20. The subsea drilling or production system of Example 19, wherein the offset between the bolt hole longitudinal axis and the riser section longitudinal axis is reduced when the bolts are made up with a flange of an adjacent riser section.

Example 21. The subsea drilling or production system of Example 14, wherein a transition between the riser section and the flange is tapered and convex.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A riser flange extending radially from an end of a riser section, the flange comprising:

a connection face comprising:

an offset face located around the connection face; and a raised face located around the connection face and raised and spaced radially inward from the offset face; and a plurality of bolt holes extending through the raised face without extending through the offset face, each bolt hole configured to receive a bolt.

2. The riser flange of claim 1, further comprising a plurality of auxiliary-line holes each configured to receive an auxiliary line.

3. The riser flange of claim 2, wherein the auxiliary lines are one or more of a choke line, a kill line, and a booster line.

4. The riser flange of claim 1, wherein the riser section comprises a longitudinal axis and each bolt hole comprises a longitudinal axis offset at an angle from the longitudinal axis of the riser section.

5. The riser flange of claim 4, wherein the offset angle between the bolt hole longitudinal axis and the riser section longitudinal axis is reduced when the bolts are made up with a flange of an adjacent riser section.

6. The riser flange of claim 1, wherein a transition between the riser section and the flange is tapered and convex.

7. The riser flange of claim 1, wherein the flange comprises six bolt holes.

8. A riser section for coupling a surface platform to a subsea wellhead, the riser section comprising:

a main tube for fluid flow between the subsea wellhead and the surface platform; and a flange extending radially from an end of the main tube, the flange comprising:

a connection face comprising:

an offset face located around the connection face; and a raised face located around the connection face and raised and spaced radially inward from the offset face; and a plurality of bolt holes extending through the raised face without extending through the offset face, each bolt hole configured to receive a bolt.

9. The riser section of claim 8, further comprising a plurality of auxiliary-line holes each configured to receive an auxiliary line.

10. The riser section of claim 9, wherein the auxiliary lines are one or more of a choke line, a kill line, and a booster line.

11. The riser section of claim 8, wherein the riser section comprises a longitudinal axis and each bolt hole comprises a longitudinal axis offset at an angle from the longitudinal axis of the riser section.

12. The riser section of claim 11, wherein the offset angle between the bolt hole longitudinal axis and the riser section longitudinal axis is reduced when the bolts are made up with a flange of an adjacent riser section.

13. The riser section of claim 8, wherein a transition between the riser section and the flange is tapered and convex.

14. A subsea drilling or production system comprising:

a subsea wellhead; and a riser string located between the subsea wellhead and a surface platform, the riser string comprising a plurality of riser sections, at least one of the riser sections comprising a flange extending radially from an end of the riser section, the flange comprising:

a connection face comprising:

an offset face located around the connection face; and a raised face located around the connection face and raised and spaced radially inward from the offset face; and a plurality of bolt holes extending through the raised face without extending through the offset face, each bolt hole configured to receive a bolt.

15. The subsea drilling or production system of claim 14, further comprising a blowout preventer located between the riser string and the wellhead.

16. The subsea drilling or production system of claim 14, further comprising a flange extending radially from each end of the riser section.

17. The subsea drilling or production system of claim 14, further comprising a plurality of auxiliary-line holes each configured to receive an auxiliary line configured to deliver pressurized fluid to the wellhead.

18. The subsea drilling or production system of claim 17, wherein the auxiliary lines are one or more of a choke line, a kill line, and a booster line.

19. The subsea drilling or production system of claim 14, wherein the riser section comprises a longitudinal axis and each bolt hole comprises a longitudinal axis offset at an angle from the longitudinal axis of the riser section.

20. The subsea drilling or production system of claim 19, wherein the offset angle between the bolt hole longitudinal axis and the riser section longitudinal axis is reduced when the bolts are made up with a flange of an adjacent riser section.

21. The subsea drilling or production system of claim 14, wherein a transition between the riser section and the flange is tapered and convex.

* * * * *